US009138372B2

(12) United States Patent
Dorronsoro Rueda

(10) Patent No.: US 9,138,372 B2
(45) Date of Patent: Sep. 22, 2015

(54) MALE MASTURBATION AID

(75) Inventor: Francisco Dorronsoro Rueda, Malaga (ES)

(73) Assignee: WE ARE YOU PATNERSHIP SOLUTIONS S.L., Malaga (ES)

( * ) Notice: Subject to any disclaimer, the term of this patent is extended or adjusted under 35 U.S.C. 154(b) by 154 days.

(21) Appl. No.: 13/979,903

(22) PCT Filed: Jan. 17, 2011

(86) PCT No.: PCT/ES2011/070023

§ 371 (c)(1),
(2), (4) Date: Jul. 16, 2013

(87) PCT Pub. No.: WO2012/098269

PCT Pub. Date: Jul. 26, 2012

(65) Prior Publication Data

US 2013/0289345 A1 Oct. 31, 2013

(51) Int. Cl.
*A61H 19/00* (2006.01)

(52) U.S. Cl.
CPC ..... *A61H 19/00* (2013.01); *A61H 19/32* (2013.01); *A61H 2201/0107* (2013.01); *A61H 2201/0192* (2013.01); *A61H 2201/1253* (2013.01); *A61H 2201/1692* (2013.01)

(58) Field of Classification Search
CPC ..... A61F 5/41; A61F 2005/411; A61F 6/00; A61F 6/02; A61F 6/04; A61H 19/30; A61H 19/34; A61H 19/40; A61H 19/50
USPC ..... 600/38–41
See application file for complete search history.

(56) References Cited

U.S. PATENT DOCUMENTS

| | | | | |
|---|---|---|---|---|
| 4,640,270 | A * | 2/1987 | Chin | 600/39 |
| 5,458,559 | A | 10/1995 | Gauntlett | |
| 2006/0264856 | A1 * | 11/2006 | Wong | 604/349 |

FOREIGN PATENT DOCUMENTS

| | | |
|---|---|---|
| DE | 202009000723 | 4/2009 |
| EP | 1891923 | 2/2008 |
| EP | 1897519 | 3/2008 |
| EP | 2168500 | 3/2010 |
| ES | 2107054 | 11/1997 |
| JP | 2001321412 | 11/2001 |
| JP | 2004275661 | 10/2004 |
| JP | 2006340871 | 12/2006 |
| JP | 2010119476 | 6/2010 |
| WO | 2010082316 | 7/2010 |

OTHER PUBLICATIONS

International Search Report dated Jun. 9, 2011, corresponding to PCT/ES2011/070023.

* cited by examiner

*Primary Examiner* — Samuel Gilbert
(74) *Attorney, Agent, or Firm* — Young & Thompson

(57) ABSTRACT

A male masturbating device includes a plurality of rings fixed together by coupling parts, the fixed-together rings forming a tubular body with an orifice for introducing a penis to perform a masturbating act, where each ring has an internal section with a design different from the design of the internal section of each of the other rings.

10 Claims, 3 Drawing Sheets

MALE MASTURBATION AID

TECHNICAL DETAILS

The purpose of this invention, as described in the title of this document, refers to a male masturbator device, this being a sex toy with a long body fitted with an orifice in which the penis is introduced, and including a group of assembled elements in different positions, that gives it its long shape.

HISTORY

Female and male masturbation, are explained as the stimulation of the genital organs with the goal of obtaining pleasure, and the possibility of reaching climax. Generally it is understood as self sexual intercourse, although it could be performed towards someone else's genitals with the same purpose.

Male masturbation is often done with the hands or by using a suitable object that causes friction, these know as sex toys that help reaching the excitement.

In particular, these types of sex toys consist in a shape or form fitted with an orifice where the penis is introduced and that have inside a design that stimulates and simulates different sexual techniques.

For the use of these devices, a lubricant gel is recommended and needed. This helps the introduction and intensifies the friction with the internal shape, being the climax and the ejaculation the final goal.

After the use, this sex toy must be thoroughly cleaned in order to eliminate any residue.

The devices that are mainly known are ES 2107054, EP 2168500, US 2006/0264856. These are described as masturbator devices formed by a body or shape fitted with an orifice where the penis is introduced and that after each use can be cleaned, thus making them re-usable.

Alternatively, one time use masturbator devices have been developed with the aim of improving the hygienic features of the product avoiding the later cleaning process. Examples of this last type are EP1891923, EP 1897519, JP2006340871.

The problem that needs solving: Current devices do not allow to modify the internal setting/placing of the orifice where the penis is introduced, so each model will only provide a different sensation depending on the morphologic internal design. This according to the user's preferences and their physical characteristics will result in more or less suitable in relation to their taste and measurements.

INVENTION DESCRIPTION

This male masturbator novelty device solves in an original and simple way the above mentioned problem, allowing the user to choose and modify the structure and internal design of the orifice, as well as the length and width dimensions. All these being possible with a re-usable device, easy maintained and at a reduced price.

This novelty masturbator device is made with several rings, fitted with an interlinked system, forming a tubular body, mainly circular, although it could also be polygonal according to the needs of the external design.

Each ring presents an internal designed section that through the association of the different rings forms the orifice or space where the penis is introduced in order to perform the sexual intercourse.

The different ring layout allows the multiple different settings of the orifice. At the same time, the quantity of selected rings as well as the internal diameter give the user the choice to adapt the device to their needs and suitable size.

The possibility of modifying the internal structure of the masturbating device according to the user's preferences opens up new opportunities for marketing this type of product, that has now became an updatable kit, able to incorporate new elements that contribute the final purpose.

At the same time, the possibility of modifying its thickness and internal diameter, makes the total adaptation to the end user even easier.

In a preferential realization, the internal section of each ring is made by an added part adapted to the external ring with fixed or removable ways of retention. This preferential setting allows the texture and hardness of the interior ring to be completely different to the one inside the external ring. This way, the device external side can be hard and tough while the interior can be soft and elastic.

The external rings, as an structure element will be rigid or semi-rigid and alternatively they can be soft with the purpose of putting pressure on with the hand thus feeling same pressure in the penis. At the same time the flexibility of the external ring allows the device to be curved or bended achieving free movements in different ways, for example swiveling or twisting movements.

The tubular body formed by the association of rings, is closed in one of the extremes by a dome piece adaptable to the same means of coupling that fix the rings.

Another advantage of this new design, is the possibility of adding new accessories such as vibrating devices, vacuum/sucking devices, strangulating devices and even self release lubricant deposits.

To the above mentioned advantages due to its versatility and multiple settings, we add the easy maintenance, as it is able to be totally cleaned after its use. This is possible as the rings can come apart for easy access to the internal structure. At the same time, this perfect access to the interior allows to user to inspect the status of the material, noticing in advanced if any there are little tears that might cause any injury. In such a case we discover another advantage, the possibility of replacing the damaged rings and not disposing the whole device.

The rings means of fixing are of mechanical type.

In a preferential realization, these means are fixed by a dovetail joint, with a ribbing on one side and a groove on the other. The grooved & ribbed sections match, in a way that the ribbing of the first ring can be inserted in the groove of the second ring, ending in a firm conjunction but allowing the rotation between them In another preferential realization, the means of fixing are set in a threaded system, existing a male nut on one side of the ring, and a female nut on the opposite side. In the same way of the previous preferential realization, the join between the rings is performed via the association of the male element of the first ring system with the female element of the second ring.

Any other means of fixing between rings is not yet discarded, for example bayonets, harpoons, magnets . . . etc

DRAWING DESCRIPTION

Figure 1:
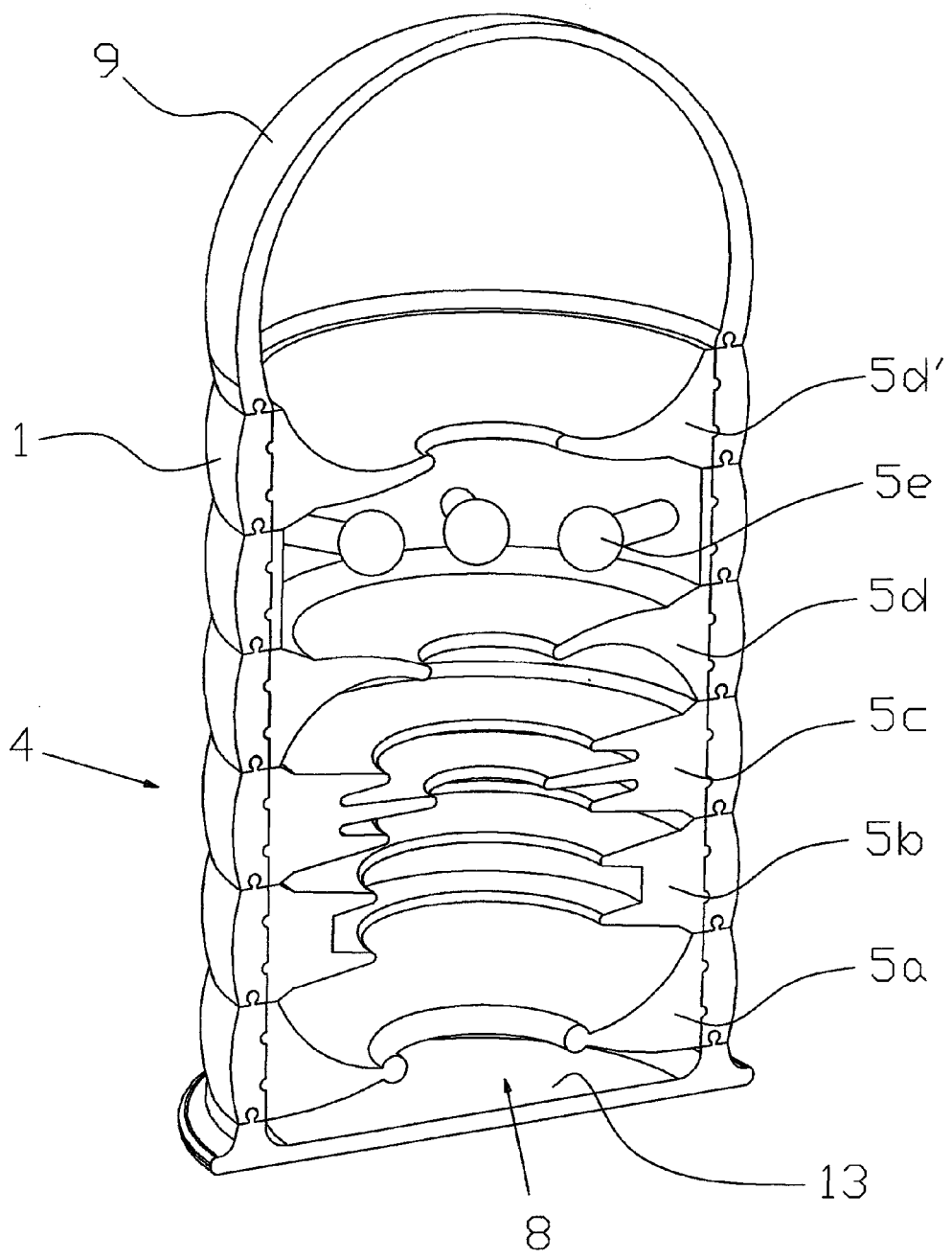
FIG. 1 shows a section view of the new masturbator device.
Figure 2:
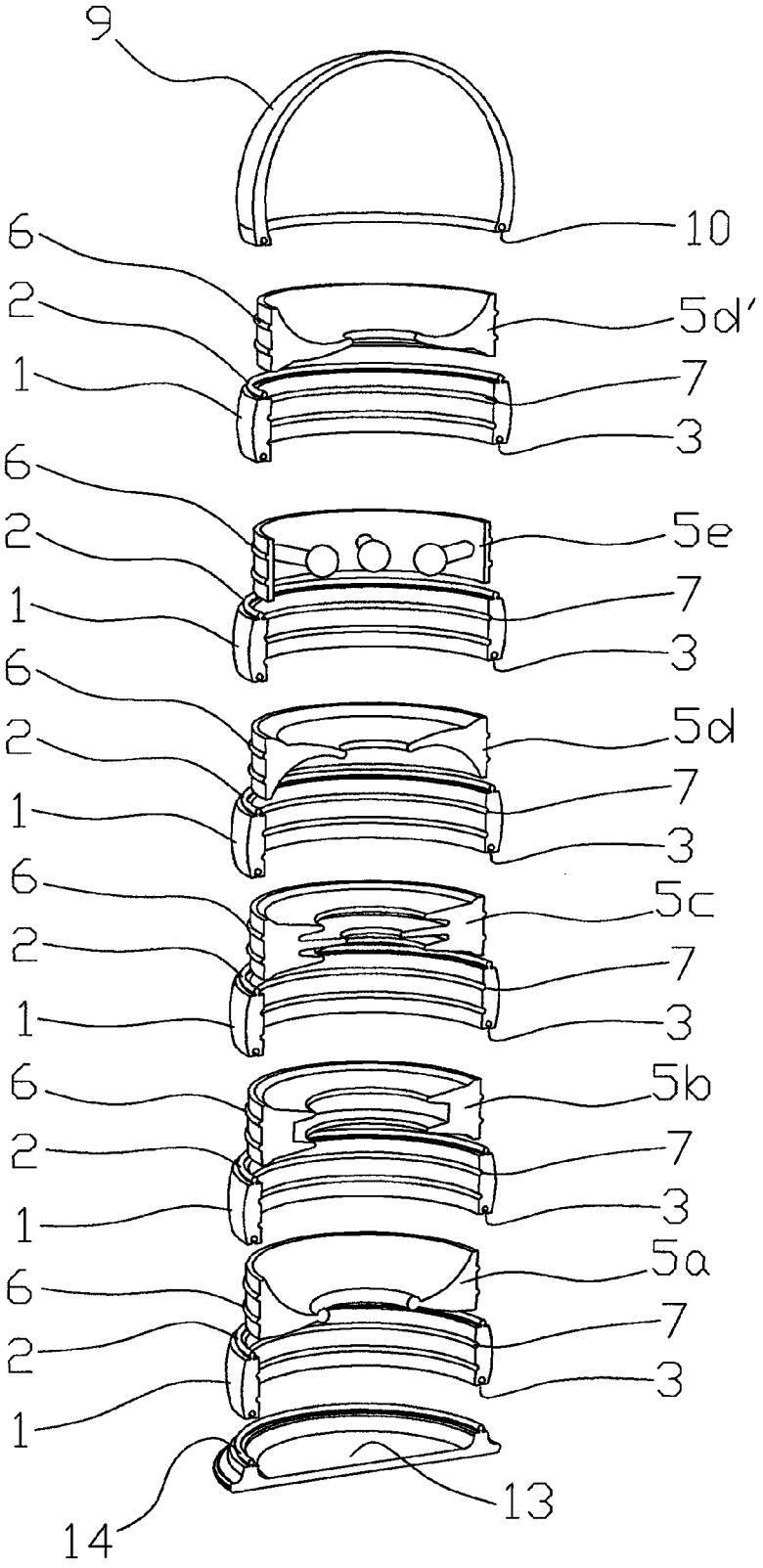
FIG. 2 shows an exploded view of same section.
Figure 3:
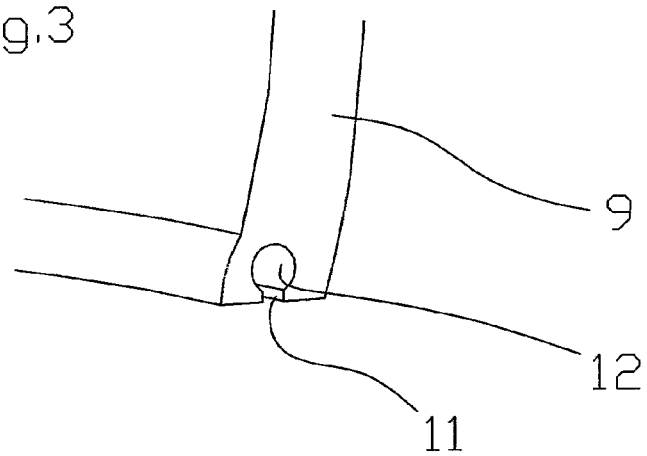

FIG. 3 corresponds to a detailed view of the grooved dome.

Figure 4:
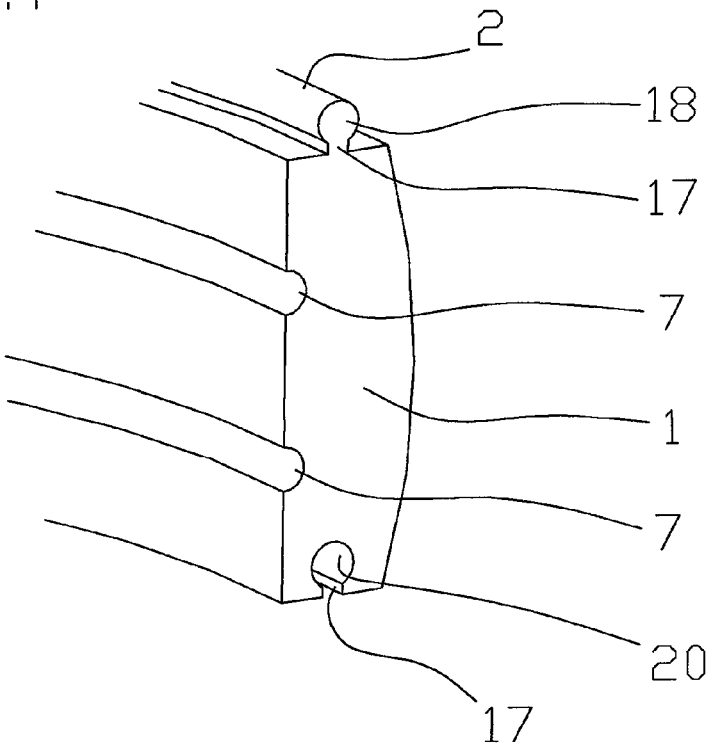

FIG. 4 corresponds to a detailed view of the ring section.

Figure 5:
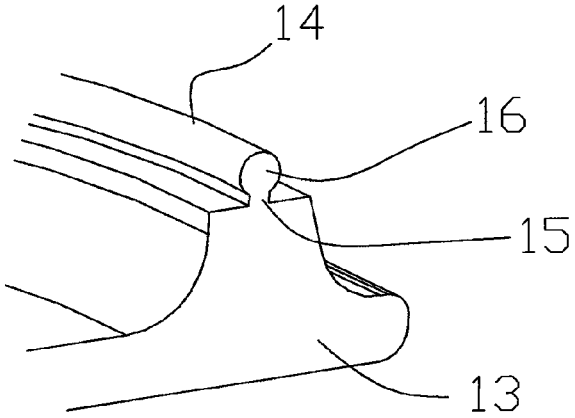

FIG. 5 corresponds to a detailed view of the ribbed lid.

DESCRIPTION OF A SAMPLE STUDY

In the figure drawings enclosed to this document, we develop a sample study of making the device object of this document.

This novelty male masturbator device is made as explained in the drawing, by a diversity of tough rigid or semi-rigid rings (1), fitted with a perimeter ribbing (2) performed on the side of the ring and a perimeter groove (3) performed on the opposite side.

The grooved and ribbed sections meet in a way that the ribbing of one ring can be inserted in the groove of the other, ending in a solid joint, but maintaining the rotary ability. In particular, each perimeter ribbing (2) presents a straight section at the beginning (17) with a circular end (18) while the perimeter groove presents a straight section at the beginning (19) with a circular end (20). This setting allows the coupling and retention of the ribbings and grooves between the different rings.

This ribbing (2) and groove (3) form an association between rings (1) in order to make a tubular body with a circular section.

Each ring (1) presents a section formed by an added part (5) which is soft and elastic, and that gets inserted in the external ring (1) with removable means of retention. These means are formed by a group of two perimeter ribbings (6) situated in the external side of the added part (5) and two perimeter grooves (7) situated in the internal side of the external ring (1). The section and position of the grooves (7) and the ribbings (6) are coincident, in a way that when the added part gets inserted (5) in an external ring (1), this one stays fixed in an stable position.

The internal section of each added part (5) presents an specific design. In particular, in the illustrated example it shows 4 different models (5*a*) (5*b*) (5*c*) (5*d*), from which one of them can be situated in two positions (5*d*) and (5*d*'s).

Through the association of the external different rings (1) with their corresponding added parts (5) inserted, the orifice (8) gets formed, and it is where the penis is introduced in order to perform the masturbating act.

The tubular body with circular section (4) is closed on one of the extremes by a dome shape piece (9), and this is fitted with a groove in its lower side (10) in which an initial straight section can be distinguished (11) and it is ended in a circular area (12). This setting of the groove allows the coupling with the perimeter ribbings (2) of the rings.

Finally, the device incorporates a closing lid (13) for conservation, fitted in its upper side with a perimeter ribbing (14) in which an initial straight section can be distinguished (15) and it is ended in a circular area (16). This setting of the ribbing allows the coupling with the perimeter grooves (3) of the rings (1).

The invention claimed is:

1. A male masturbating device, comprising:

a plurality of rings (1), coupling means fixing together each adjacent pair of said rings (1), the fixed-together rings forming a tubular body (4) with an orifice (8) for introducing a penis to perform a masturbating act, and wherein each ring has an internal section with a design different from the design of the internal section of each other one of the rings.

2. The male masturbating device according to claim 1, wherein the internal section of each ring comprises an added part (5*a*, 5*b*, 5*c*, 5*d*, 5*d*', 5*e*) located in an interior of each ring (1) and around the orifice (8), each added part fixed with retention means to the interior of each ring.

3. The male masturbating device according to claim 2, wherein, a first of the rings includes a first one of the added part (5*a*), a second of the rings includes a second one of the added part (5*b*), a third of the rings includes a third one of the added part (5*c*), a fourth of the rings includes a fourth one of the added part (5*d*, 5*d*'), a fifth of the rings includes a fifth one of the added part (5*e*), and each of the first, second, third, fourth, and fifth added parts (5*a*, 5*b*, 5*c*, 5*d*, 5*d*', 5*e*) is different from the remaining ones of the first, second, third, fourth, and fifth added parts (5*a*, 5*b*, 5*c*, 5*d*, 5*d*', 5*e*).

4. The male masturbating device according to claim 1, wherein the coupling means each comprise i) a ribbing area (2) disposed on a first side of a corresponding one of the rings (1), and ii) a groove area (3) disposed on an opposite, second side of the corresponding one of the rings, the ribbing area and the groove area being coincident areas, such that the ribbing of a first of the rings (1) can be inserted in the groove area (3) of a second of the rings (1).

5. The male masturbating device according to claim 4, wherein, the ribbing (2) disposed on the first side presents an area with an initial straight section that ends in a circular area (18), and the groove area (3) disposed on the second side presents an area with an initial straight section (17) that ends in a circular area (20).

6. The male masturbating device according to claim 4, further comprising a lid with a seal (13), the lid having an upper area (14) fitted with a perimeter ribbing.

7. The male masturbating device according to claim 6, wherein the perimeter ribbing (14) presents an initial straight section (15) that ends with a circular area (16), the perimeter ribbing (14) allowing coupling of the lid with the groove area (3) of an endmost one of the rings (1).

8. The male masturbating device according to claim 1, wherein the tubular body (4) is closed at one extreme end by a dome shaped piece (9) and fitted to an adjacent one of the rings with one of the coupling means.

9. The male masturbating device according to claim 8, wherein the one coupling means of the dome shaped piece (9) comprises a groove.

10. The male masturbating device according to claim 9, wherein the groove of the one coupling means of the dome shaped piece (9) comprises an initial straight section (11) that ends in a circular area (12).

* * * * *